US010280047B2

(12) United States Patent
Falk et al.

(10) Patent No.: US 10,280,047 B2
(45) Date of Patent: May 7, 2019

(54) LIFTING JIG FOR LIFTING ELEMENTS ALONG THE FACADE OF A BUILDING

(71) Applicant: BRUNKEBERG SYSTEMS AB, Helsingborg (SE)

(72) Inventors: Henrik Falk, Stockholm (SE); David Simlund, Stockholm (SE); Peter Sandström, Upplands Väsby (SE)

(73) Assignee: BRUNKEBERG SYSTEMS AB, Helsingborg (SE)

( * ) Notice: Subject to any disclaimer, the term of this patent is extended or adjusted under 35 U.S.C. 154(b) by 0 days.

(21) Appl. No.: 15/565,860

(22) PCT Filed: Apr. 11, 2016

(86) PCT No.: PCT/SE2016/050301
§ 371 (c)(1),
(2) Date: Oct. 11, 2017

(87) PCT Pub. No.: WO2016/167706
PCT Pub. Date: Oct. 20, 2016

(65) Prior Publication Data

US 2018/0111802 A1 Apr. 26, 2018

(30) Foreign Application Priority Data

Apr. 13, 2015 (SE) ..... 1550439

(51) Int. Cl.
*B66C 1/66* (2006.01)
*E04B 2/88* (2006.01)

(52) U.S. Cl.
CPC . *B66C 1/66* (2013.01); *E04B 2/88* (2013.01)

(58) Field of Classification Search
CPC ..... B63C 11/52; E02B 17/0034; B63G 8/001; B66C 1/66; E04B 2/88
See application file for complete search history.

(56) References Cited

U.S. PATENT DOCUMENTS

2007/0280795 A1* 12/2007 McDaniel ..... B23B 47/287 408/115 R
2011/0155683 A1* 6/2011 Kim ..... B66C 1/101 212/307

(Continued)

FOREIGN PATENT DOCUMENTS

FR 2304735 A1 10/1976
JP H10140718 A 5/1998

(Continued)

OTHER PUBLICATIONS

Brunkeberg Curtain Wall Installation Demo [Video sequence from YouTube]. Retrieved Jun. 17, 2016] [Published Sep. 10, 2014] Retrieved from the Internet: <URL: https://www.youtube.com/watch?v=z5lrKpd1s5A>; Time: 0.11-0:15, 0.30-0.34, 0:40-0:47, 0:52-1:58 (abstract).

(Continued)

*Primary Examiner* — Stephen A Vu
(74) *Attorney, Agent, or Firm* — Ballard Spahr LLP

(57) ABSTRACT

A lifting jig for lifting elements, comprising:
- a base frame comprising parallel first and second vertical support beam to be slidably received into two parallel guide profiles mounted on a façade of a building;
- a lifting yoke comprising a horizontal base beam and a lifting frame extending vertically from said base beam;
- a lifting rail for engaging a façade panel, said lifting rail extending from said horizontal base beam,
- a link arrangement for pivotally coupling the lifting yoke to the base frame such that the lifting yoke is movable from a element lifting position (A) to a element engagement position (B).

17 Claims, 10 Drawing Sheets

(56) References Cited

U.S. PATENT DOCUMENTS

| | | | | |
|---|---|---|---|---|
| 2011/0176893 | A1* | 7/2011 | Nakamura | H01L 21/67766 414/217.1 |
| 2011/0190927 | A1* | 8/2011 | Douki | G06F 7/00 700/228 |
| 2011/0214586 | A1* | 9/2011 | Wessel | B25J 5/00 104/23.2 |

FOREIGN PATENT DOCUMENTS

| | | | |
|---|---|---|---|
| JP | H1181682 | A | 3/1999 |
| WO | WO-2010/070082 | A1 | 6/2010 |
| WO | WO-2011/073026 | A1 | 6/2011 |

OTHER PUBLICATIONS

The Brunkeberg System for Curtain Wall Re-Cladding [Video sequence from YouTube]. [Retrieved Jun. 17, 2016] [Published Sep. 10, 2014] Retrieved from the Internet: <URL: https://www.youtube.com/watch?v=Flink2HrhVY> (Whole document; abstract).

The Brunkeberg System—Installation Overview [Video sequence from YouTube]. [Retrieved Jun. 17, 2016] [Published Sep. 10, 2014] Retrieved from the Internet: <URL: https://www.youtube.com/watch?v=YVAobuL886c> (Whole document; Abstract).

International Search Report and Written Opinion dated Jun. 20, 2016 by the International Searching Authority for Patent Application No. PCT/SE2016/050301, which was filed on Apr. 11, 2016 and published as WO 2016/167706 on Oct. 20, 2016 (Inventor—Falk et al.; Applicant—Brunkeberg Systems AB) (11 pages).

Bosch Rexroth: "Cam Roller Guides",(2012-),Retrieved from the Internet: URL: https://md.boschrexroth.com/modules/BRMV2PDFDownload-internet.dll/R310EN_2101_2004-09.pdf?db=brmv2&lvid=1172661&mvid=13726&clid=20&sid=61D4E2E35366471F17D59922158004F9.borex-tc&sch=M&id=13726,20,1172661 [retrieved on Dec. 19, 2018].

European Search Report dated Dec. 14, 2018 by the European Patent Office for EP Application No. 16780377.4, filed on Apr. 11, 2016 and published as EP 3283427 A1 on Feb. 21, 2018 (Applicant—Brunkeberg Systems AB) (10 Pages).

* cited by examiner

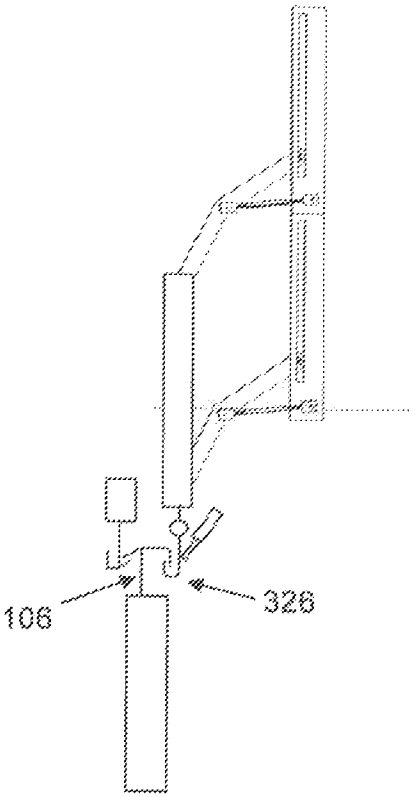
Fig 5d
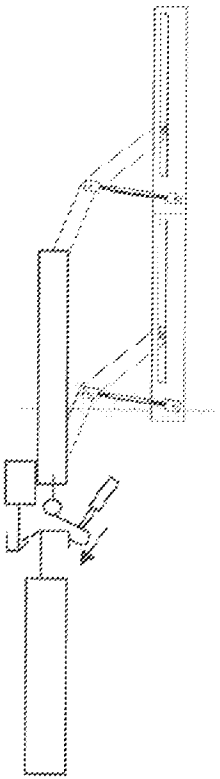
Fig 5c
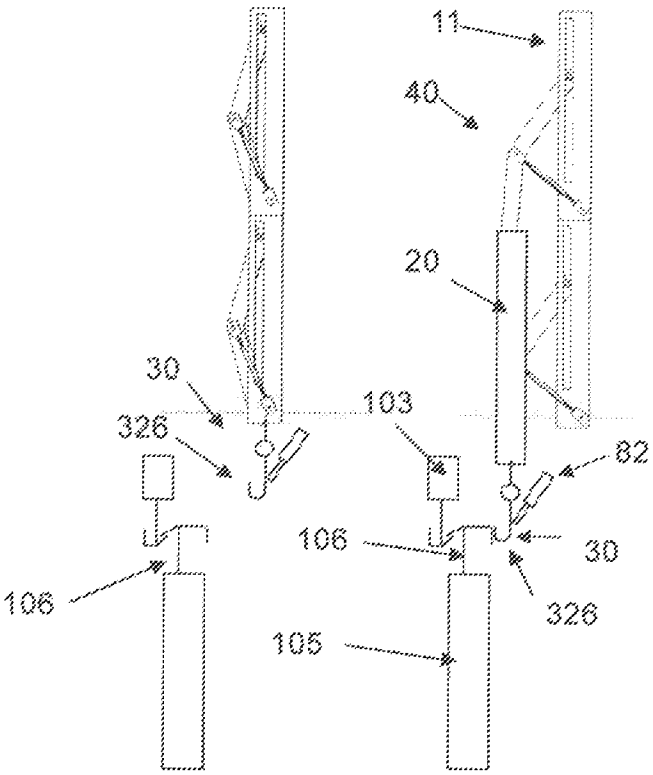
Fig 5b
Fig 5a

LIFTING JIG FOR LIFTING ELEMENTS ALONG THE FACADE OF A BUILDING

CROSS-REFERENCE TO RELATED APPLICATIONS

This application is a U.S. National Phase Application of International Application No. PCT/SE2016/050301, filed Apr. 11, 2016, which claims priority to Swedish Application No. 1550439-2 filed Apr. 13, 2015, each of which are hereby incorporated by reference in their entirety.

TECHNICAL FIELD

The present disclosure relates to a lifting jig for lifting façade elements.

BACKGROUND ART

Multi-storey buildings can be constructed in a variety of ways. Common to all multi-storey buildings, however, is a façade element. The façade element can be constructed to constitute an integral part of the building as a load bearing component or it may only serve as a weather protective layer. There may of course also be different combinations of façade elements with load bearing properties and weather protective layers. If the façade element only is used as a weather protective layer to seal the building then it is usually formed as a plate. In such a case the multi-storey building comprises a building structure onto which the plate formed façade elements are attached.

It is common that the façade elements arrive at the working site on pallets. These pallets are then off-loaded by a tower crane, a mobile crane, a site hoist or the like and lifted to the floor of the multi-storey building on which they are to be installed. This step of lifting and installing façade elements is one of the most time consuming tasks when a new multi-storey building is built. Thus, by reducing this time it is possible to reduce the overall time it takes to complete the whole multi-storey building. A further drawback of the conventional construction method is that handling and storage of the façade elements occupies space on the construction site. Moreover, unloading, transporting and installation of the façade panels demands a lot of manual labour Brunkeberg Systems AB has developed an efficient method for mounting façade elements which substantially reduces the time to unload, lift and mount façade elements on a building structure of a multi-storey building. According to the method, which is disclosed in WO2010070082, façade elements are transported on a conveyer directly from a delivery truck to a multi-storey building. The façade elements are then hoisted by an elevator unit, i.e. a crane, whilst inserted in slots of guiding rails mounted on the building structure, i.e. the vertical edges of the façade element will run in slots while hoisted. This will make the hoisting procedure less sensitive to weather conditions, such as wind, since the façade elements run steadily in the slots. The guiding-rails are mounted on the building structure all the way up to the floor that is beneath the floor to be installed, i.e. with this method the façade elements are mounted from the bottom and up. When the façade elements have reached the floor on which they are to be installed they are pushed in a horizontal direction towards the building and attached appropriately to the building.

In the method disclosed in WO2010070082, the façade elements are moved from the conveyor to the guiding rails by an elevator unit provided with a gripping device for gripping the façade element. In operation, the elevator unit angles out such that the gripping device may grip the façade element. As the elevator unit then moves upwards the façade element is moved inwards towards the building and enters into the guiding rails.

The gripping device may also first be moved into a gripping position whereby the façade elements subsequently are moved into engagement with the gripping device.

However, although the device of WO2010070082 has proved to be useful, it suffers from some drawbacks. In particular it is bulky and it is cumbersome and time consuming to move the gripping device in position for gripping a façade element.

Thus, it is an object of the present disclosure to achieve a device for gripping and moving façade elements which addresses at least one of the aforementioned problems.

In particular, it is an object of the present disclosure to achieve an effective device for gripping and moving façade elements. A further object of the present disclosure is to achieve a device for gripping and moving façade elements which device is easy to handle and requires a little manual labour. Yet a further object of the present disclosure is to provide a device for gripping and moving façade elements which is of simple construction.

SUMMARY OF THE DISCLOSURE

According to a first aspect of the present disclosure at least one of these objects is achieved by A lifting jig (1) for lifting elements (105) along the façade of a building, comprising:

- a base frame (10) comprising parallel first and second vertical support beam (11, 12) to be slidably received into two parallel guide profiles mounted on a façade of a building;
- a lifting yoke (20) comprising a horizontal base beam (22) and a lifting frame (21) extending vertically from said base beam (22);
- a lifting rail (30) for engaging an element (105) to be lifted, said lifting rail (30) extending from said horizontal base beam (22),
- a link arrangement (40) for pivotally coupling the lifting yoke (20) to the base frame (10) such that the lifting yoke (20) is movable from an element lifting position (A) to an element engagement position (B), wherein the link arrangement (40) comprises at least two links (41, 43), each link comprising a pivot arm (51, 53) and a push rod (61, 63) and a carriage (71, 73), wherein, one end of each pivot arm (51, 53) is pivotally attached to a carriage (71, 73) and the other end of each pivot arm (51, 53) is pivotally attached to the lifting yoke (20) and one end of each push rod (61, 63) is pivotally attached to a pivot arm (51, 53) and the other end of each push rod (61, 63) is pivotally attached to the first and the second vertical support beam (11, 12), respectively, characterized in that the first and second vertical support beam (11, 12) respectively comprises a guide rail (16) having a first and a second opposing flange (16.2, 16.3) and extending along at least a portion of said first and second vertical support beam (11, 12) in direction from an upper end (11.1, 12.1) towards a lower end (11.2, 12.2) thereof and that, the first and the second carriage (71, 73) respectively comprises at least one guide means (17) arranged between the opposing flanges (16.2, 16.3) of the respective guide rail (16), wherein said at least one guide means (17) is movable between the first and the second opposing flange (16.2, 16.3) along said guide rail (16).

A particular advantage of the lifting jig is provided by the link arrangement of pivotally arranged pivot arms and push rods in combination with the axially movable carriages on the vertical support beams. In operation, the link arrangement allows the lifting yoke to perform a controlled and predefined arc-shaped movement outwards and downwards with respect to the support beams, which remain guided in the guide profiles on the façade. The lifting yoke is thereby moved from a lifting position, in which the lifting yoke is placed between the two parallel support beams of the lifting jig, to a façade engagement position in which the lifting yoke is precisely positioned to engage and pick up a façade element. When the façade element and the lifting rail on the yoke have engaged, the linkage arrangement returns the lifting yoke in exactly the same movement path, to the lifting position between the parallel support beams of the lifting jig. Obviously, the predefined and stable path of movement provided by the linkage allows the lifting jig to be used with a minimum of manual labour. An important factor for achieving the well defined movement of the yoke resides in that each carriage is guided in a guide rail which extends along a respective vertical beam. By means of engagement between the guide of each carriage and the opposing flanges of a guide rail all movement in directions other than along the guide rail is avoided and a smooth transition of the carriages and therefore also the yoke is guaranteed.

A further and considerable advantage of the lifting jig is that the movement of the lifting yoke is operated without any auxiliary powered actuators. Thus, no electrically, hydraulically or pneumatically devices are acting on the lifting yoke during its movement from the element lifting position (A) to the element engagement position (B), and back. Instead, due to the movably carriages on the support beams in combination with the pivot arm-push rod arrangement, the weight of the lifting yoke itself suffices to force the linkage arrangement to extend. The lifting yoke is thereby of a simple and robust construction and does not involve media hoses or electrical conduits which may tangle up and cause operational stops. The overall simple and robust design of the lifting jig makes it possible to operate at very low maintenance costs.

According to an alternative of the lifting jig at least a portion of the lifting rail 30 is pivotally arranged at the base beam 22. This provides a particular advantage since it allows the lifting jig to engage an façade element which already has been placed in a position for engagement with the lifting yoke. The installing time for the entire façade is thereby considerably reduced, since a new façade elements may be moved in place for lifting at the same time as a façade element is hoisted by the lifting jig.

According to an alternative, the lifting jig 1 comprises a centring-locking device 200 for centring and locking the lifting rail 30 in engagement with a façade element lifting profile.

Further features and alternatives of the lifting jig are disclosed in the detailed description and the attached claims.

BRIEF DESCRIPTION OF THE DRAWINGS

FIG. 5*a*-5*d*: Schematically side view drawings of the lifting jig according to an alternative in various positions.

DEFINITIONS

Where in the description reference is made to the geometrical form of the lifting rail it is the cross-sectional shape that is intended. It should be appreciated that the lifting rail is elongated and has the same cross-sectional shape throughout its length.

DETAILED DESCRIPTION OF EMBODIMENTS

Figure 1:
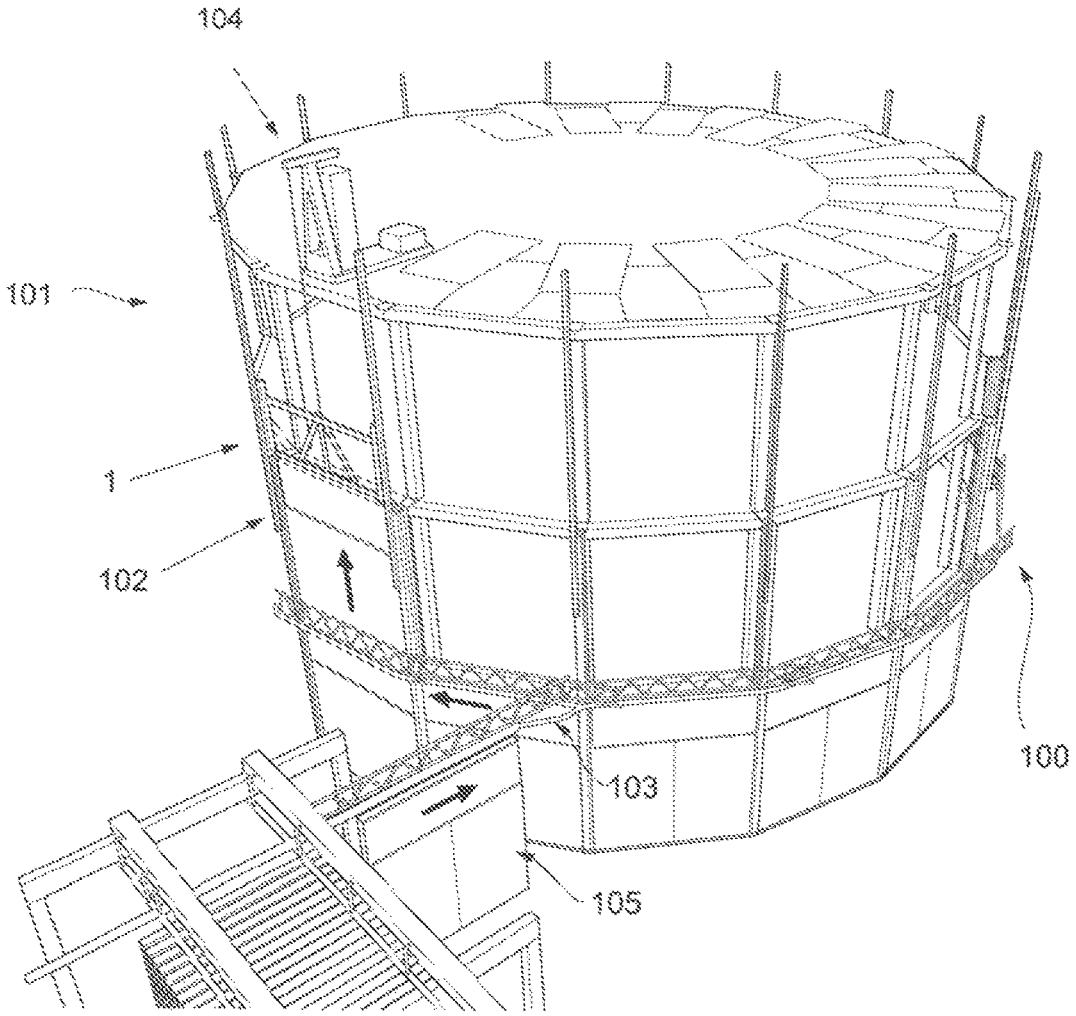
FIG. 1: A schematically perspective drawing of a façade mounting system.

FIG. 1 shows a building site of a multi-storey building 100 in which a mounting system 101 of the initially described art is employed. Guide profiles 102, also called wind posts, are erected around the building from the ground up to the various floors of the building. A conveyor 103 is located outside the guide profiles. The conveyor transports façade element 105 from a storage (not shown) to the building 100. A lifting jig 1 is guided in the guide profiles 102 and is arranged to be moved by a crane 104 up and down from the conveyor 103 to a floor of the building. In operation, the lifting jig 1 is lowered by the crane 104 to the level of the conveyor 103 to engage a façade element 105 hanging on the conveyor 103 and move it into the guide profiles 102 so that the façade element can be hoisted up to a floor of the building and be installed. It is also possible to lift other elements than façade elements along the façade or the exterior of the building. For example containers for holding goods.

Figure 2A:
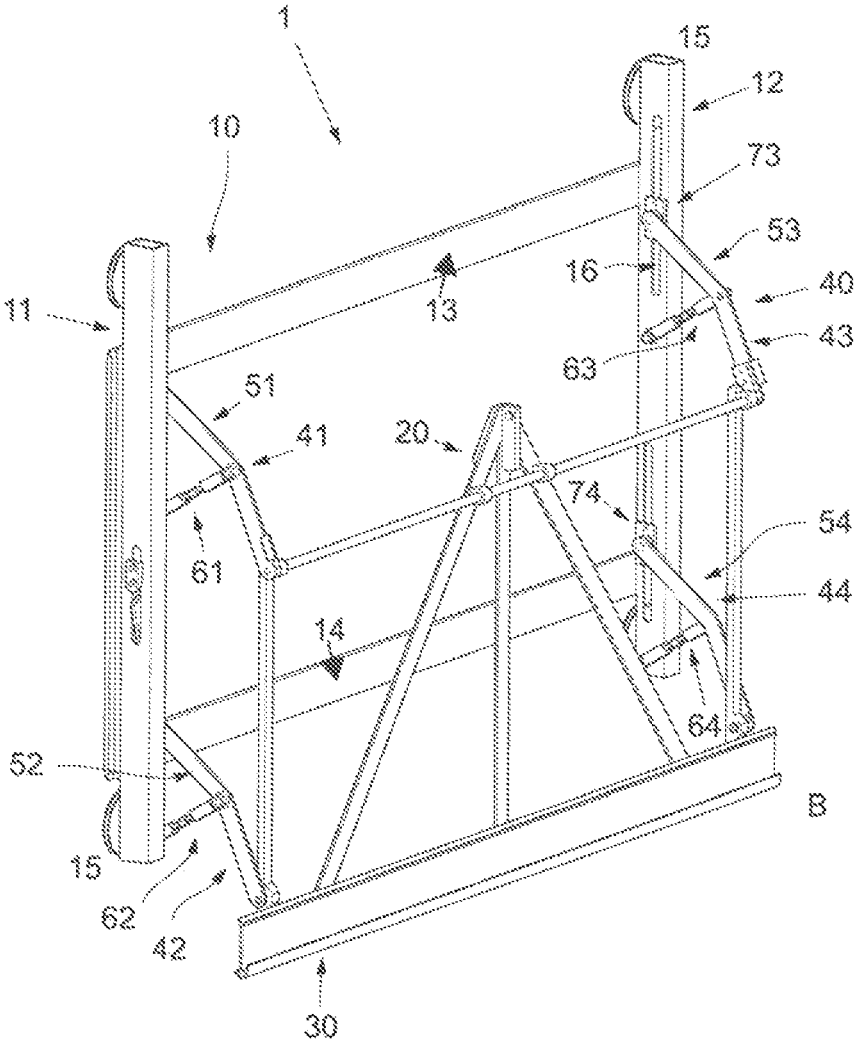
FIG. 2*a*, 2*b*: Schematically perspective drawings of the lifting jig in engagement position and lifting position, respectively.
Figure 2B:
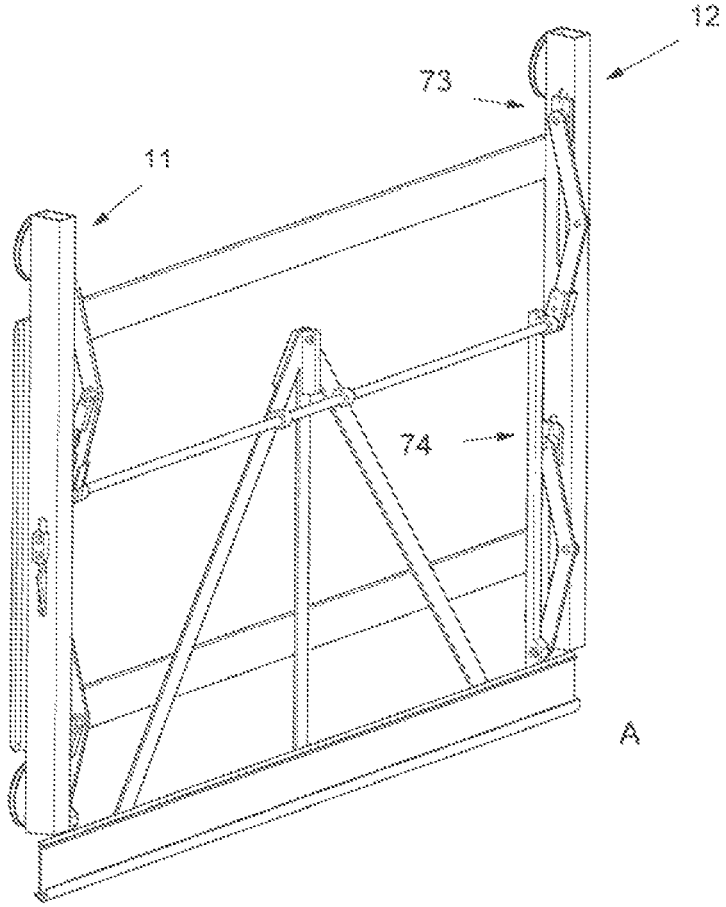

The lifting jig according to the disclosure will in the following be described in detail with reference to FIG. 2*a* which shows the lifting jig in an engagement position B for engaging an element in the form of a façade panel hanging on a conveyor. FIG. 2*b* shows the lifting jig 1 in a lifting position A in which the lifting jig is in position between the support beams 11, 12 of the lifting jig. Returning to FIG. 2*a*, the lifting jig 1 comprises a base frame 10, a lifting yoke 20 on which a lifting rail 30 is supported and a linkage arrangement 40. The linkage arrangement 40 couples the base frame 10 with the lifting yoke 20 so that the lifting yoke 20 may be moved from the engagement position B of FIG. 2*a* to the lifting position A of FIG. 2*b*.

The base frame 10 comprises two vertical support beams 11 and 12 which are interconnected by two horizontal bars 13, 14 so that the base frame 10 is mechanically stable. The support beams 11 and 12 are hollow and of rectangular cross-section. The support beams may, however be of any cross-section and size under the condition that they fit movable into the guide profiles on the building. To facilitate movement of the lifting jig in the guide profiles, each support beam is provided with a set of wheels 15. The support beams 11, 12 further comprises guide rails 16 for guiding the movement of the carriages 71, 72, 73, 74 in axial direction along each vertical support beam 11, 12. The guide rails 16 will be described in detail with reference to FIG. 2*c*.

Figure 3A:
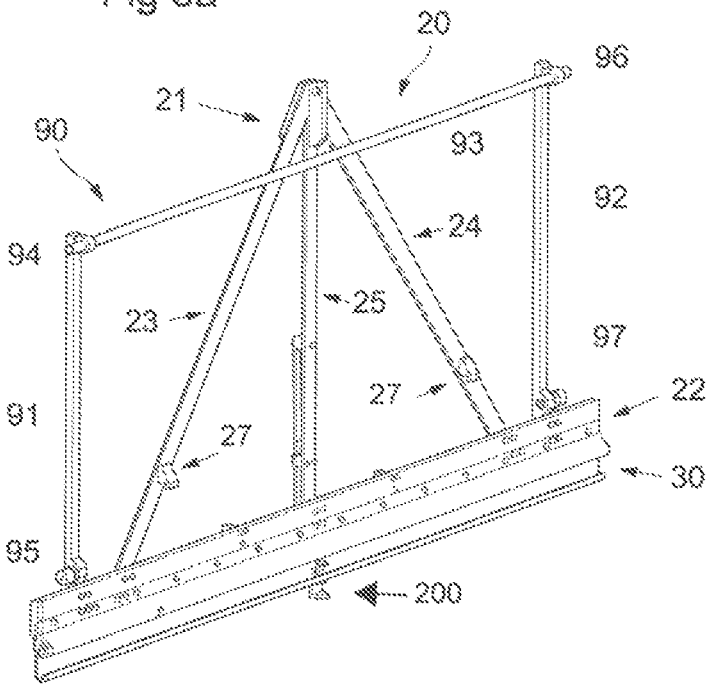
FIG. 3*a*, 3*b*: Schematically perspective drawings of front and back of the lifting yoke of the lifting jig according to an alternative.

FIG. 3*a* shows a detailed perspective front view of the lifting yoke 20. The yoke 20 comprises a horizontal base beam 22 to which a lifting rail 30 is attached. The lower edge of the lifting rail is hook-shaped, so that the lifting rail may engage a façade element. A lifting frame 21 extends vertically from the base beam 22, in opposite direction from the lifting rail 30. In operation the wire from a hoisting crane is attached to the top of the lifting frame 21 so that the entire lifting jig 1 is lifted in the lifting frame 21. The lifting frame 21 comprises two lifting beams 23, 24 which are attached to the base beam 22, on either side of the centre of the base beam 22. The two lifting beams 23, 24 are joined together over the center of the base beam 22 so that they form a triangular structure with the top point over the centre of the base beam. This allows for a simple and accurate centering of the lifting jig during hoisting. A further lifting beam 25 may be provided for strength. The lifting jig further comprises a linkage frame 90 which comprises vertical linkage rods 91, 92 which extends vertically from the base beam 22, on either side of the lifting beams 23, 24. As can been seen in FIG. 3*a*, the linkage rods are arranged parallel. A third linkage rod 93 extends horizontally between the parallel linkage rods 91, 92. The third, horizontal linkage rod 93 is rotationally attached into lockable torsion rod guides (not shown) in the upper ends of the parallel linkage rods 91, 92. The third horizontal linkage rod 93 provides for stability of the linkage frame 90. However, the third horizontal and rotational linkage rod 93 and the lockable torsion guides also allow for fine angular adjustments of the lifting yoke 20. Pivot pins 94-97 for pivotal attachments to the arms of the linkage arrangement are provided in the upper and lower ends of the vertical linkage rods 91, 92.

The lifting yoke 20 may also comprise contact elements 27 for abutting against the conveyor 103 when the lifting yoke is moved into an element engagement position B. The contact elements 27 which may be L-shaped angular irons may be attached to the lifting beams such that they extend horizontally. In operation, the contact elements ensure that the lifting yoke and the conveyor are in the right position with regards to each other.

Figure 3B:
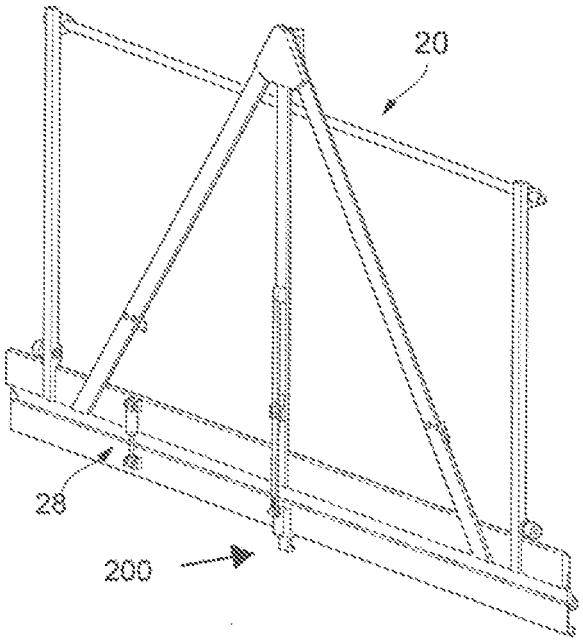

The lifting yoke also comprises a spring element 28, for example a gas spring which is biasing the lifting rail in direction of its hook. The spring element 28, see FIG. 3*b*, may be attached to the base beam 22 such that it actuates a force on the lifting rail 30.

The lifting yoke may also comprise a centring-locking device 200 for centring and locking the lifting rail 30 in engagement with a façade element lifting profile.

Returning to FIG. 2*a*. The linkage arrangement 40 comprises four identical links 41, 42, 43, 44. Each link comprises a pivot arm 51, 52, 53, 54; a push rod 61, 62, 63 64 and a carriage 71, 72, 73, 74. Each carriage 71-74 is movable along a respective guide rail 16 which extends along each of the vertical support beams 11, 12. Carriage 73 and 74 are movable along a guide rail 16 on support beam 12 (see FIG. 2*b*) and carriage 71 and 72 (not shown) are movable along a guide rail 16 pin support beam 11 The guide rail 16 may be a continuous guide rail, or as shown in FIG. 2*a*, two separate guide rails may be provided on each support beam 11, 12. Instead of guide rails it is possible to guide the carriages 71-74 in grooves or slots which are formed by e.g. machining in the vertical support beams 11, 12.

To each carriage 71, 72, 73, 74 is one end of an arm 51, 52, 53, 54 pivotally attached so that the arm may swing. The other end of each arm is pivotally attached to the lifting yoke, i.e. to the pivot pins 94-97 on the linkage frame. The first end of a push rod 61, 62, 63, 64 is pivotally attached to the arm and the second end of the push rod is pivotally attached to the support beams 11, 12. As can be seen in FIG. 2*a*, the second end of each push rod is pivotally attached to a support beam in a position below the carriage 71, 72, 73, 74, i.e. below the movement path of the carriage. The rods 61, 62, 63, 64 thereby push the pivot arms outwards in an arc during the downward movement of the carriages. The extent of the movement of the lifting yoke depends on the length of the push rods 61, 62, 63, 64 and the length and shape of the pivot arms 51, 52, 53, 54 and may be determined by the skilled person for specific lifting circumstances. However, to facilitate the outwards movement of the arms it is preferred that the pivot arms are slightly angled outwards from support beams 11, 12. More preferably, the pivot arms are bent into an angle and the push rod is pivotally attached in the area of the bend. Since the pivot arms are interconnected by the linkage rods 91, 92, 93 the yoke 20 pivots as one unit.

The guide rail 16 and the carriages 71 will hereinafter be described with reference to FIG. 2*c*-2*f*.

Figure 2C:
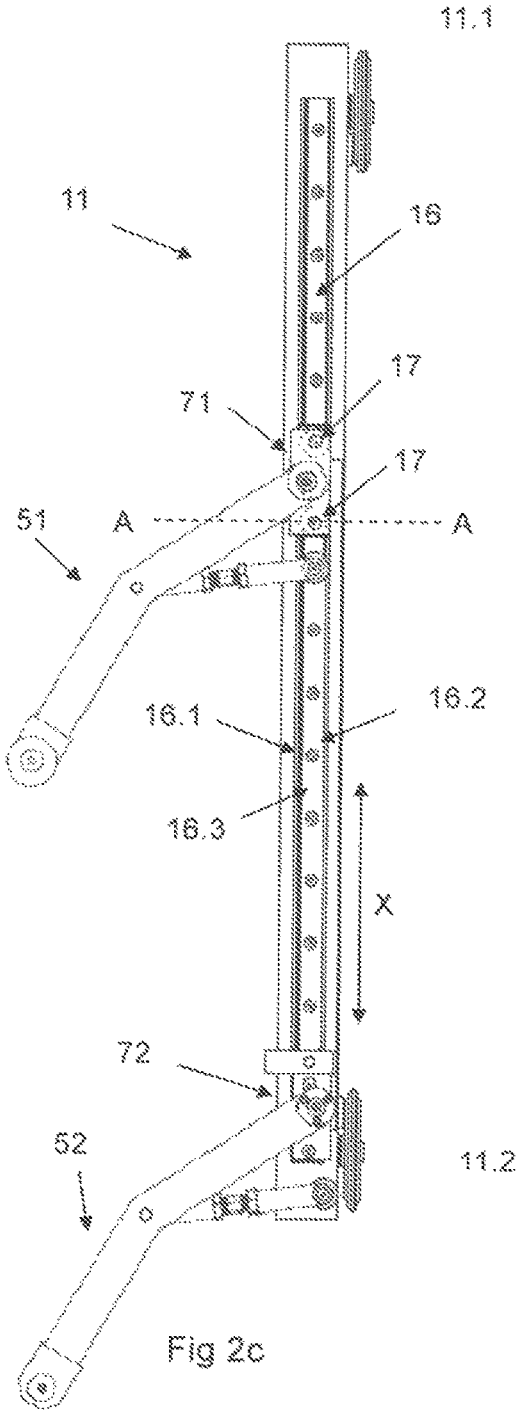
FIG. 2*c*: A schematically side view drawing of the vertical beam of a lifting jig according to a preferred embodiment of the present disclosure.

FIG. 2*c* shows a side view of the first vertical support beam 11. It is appreciated that the second vertical support beam 12 is identical to the first vertical support beam 11 but reversed with respect thereto. Therefore, when a feature is described with reference to the first vertical support beam the same description is valid for a corresponding feature of the second vertical support beam 12.

The first vertical support beam 11 comprises an elongate guide rail 16 which extends along the first support beam 11 in direction from the upper end 11.1 of the first support beam 11 towards its lower end 11.2. The guide rail 16 thereby extends parallel to a longitudinal axis X which extends between the upper and lower ends of the support beams 11 and 12.

When reference is made to "movement along said guide rail 16" this is meant movement along the guide rail 16 in direction towards or away from the upper end 11.1, 12.1 respectively towards or away from the lower end 11.2, 12.2 of the support beams 11, 12.

The guide rail 16 is attached on an external surface of the first vertical support beam 11. The external surface of the first support beam faces an external surface of the second vertical support beam 12 to which an identical guide rail is attached (not shown in FIG. 2*c*). The exact length of the guide rail may vary in dependency of the external factors, such as the size of the element to be lifted. However, the guide rail extends over a major portion of the support beam, such as at least half of the support beam. Two carriages 71, 72 which carries pivot arms 51, 52 are movable along the guide rail 16.

Figure 2D:
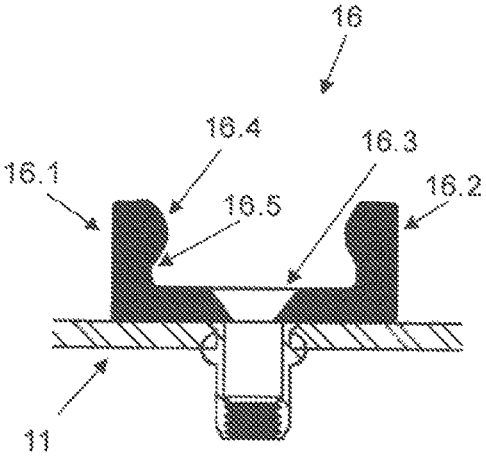
FIG. 2*d*-2*f*: Schematically drawings of the guide rail and the carriage of the lifting jig according to a preferred embodiment of the present disclosure.

FIG. 2*d* shows the guide rail 16 in cross-section. The guide rail 16 comprises a bottom 16.3 which is flat and which is supported on the surface of the vertical support beam 11. The rail 16 may be attached to the vertical support beam by screws. The guide rail 16 further comprises a first and a second flange 16.1, 16.2. The flanges 16.1, 16.2 extends orthogonally from the bottom 16.3 of the guide rail and forms between them a space which is configured to receive guide means of the carriages 71. 72. Typically, the opposing flanges 16.1, 16.2 extend throughout the length of the guide rail 16. The opposing flanges 16.1, 16.2 further extend thereby parallel with the longitudinal axis X.

Each flange 16.1, 16.2 comprise a ridge 16.4 which extends along the respective flange 16.1, 16.2 throughout the length of the guide rail. The ridges 16.4 are arranged on the inner surfaces of the flanges 16.1, 16.2 such that the ridge 16.4 of the first flange 16.1 faces the ridge 16.4 of the second flange 16.2. The ridges 16.1, 16.2 extend inwards, in direction towards the centre of the guide rail 16 such that an undercut 16.5 is formed between the ridge 16.4 and the bottom 16.3 of the guide rail 16.

Figure 2E:
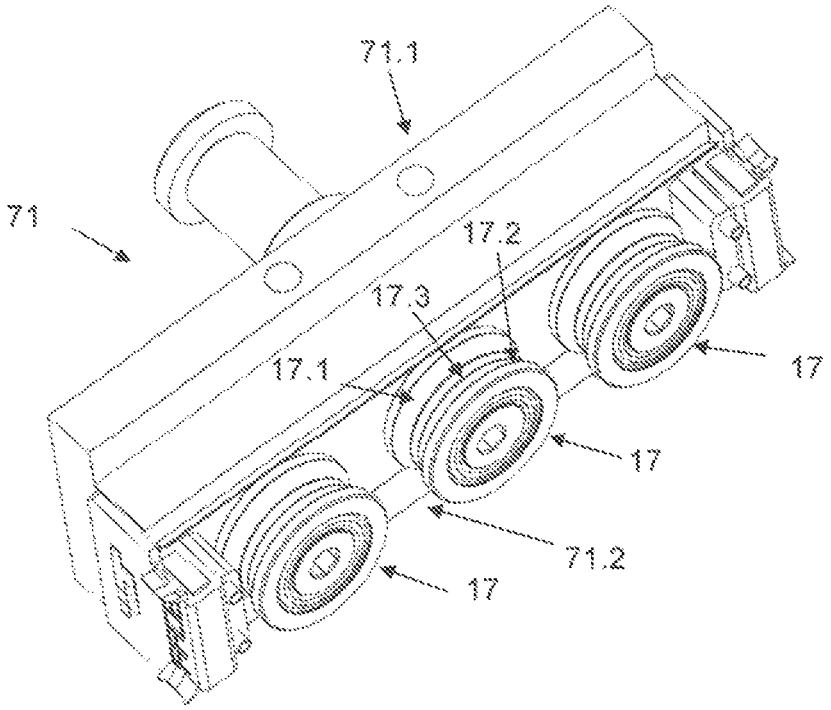

Turning to FIG. 2*e*. The carriage 71 comprises an outer surface 71.1 to which the pivot arm may be rotationally attached and an opposing inner surface 71.2 which comprises guide means 17 for engaging the opposing flanges of the guide rail 16 in order to smoothly guide the carriage 17 along the guide rail 16. In FIG. 2*e*, the guide means 17 are rolls which are rotational symmetric and rotationally attached to the inner surface 71.2 of the carriage 71, for example by means of a shaft or by bearings. Instead of rolls it is also possible to use glide blocks as guide means (not shown). In FIG. 2*e*, the carriage 71 comprises three rolls 17. However any other number of rolls may be arranged on the carriage, for example one roll or two rolls or more.

The guide means 17 are configured to be received between the flanges 16.1, 16.2 of the guide rail 16 such that the guide means 17 are moveable between the flanges 16.1, 16.2 along the guide rail 16. The guide means 17 are thereby dimensioned to fit into the space between the flanges 16.1, 16.2. The guide means 17 may thereby be dimensioned to be in contact with both of the opposing flanges 16.1, 16.2. Alternatively, the guide means 17 may be dimensioned such that there is a small play between the guide means 17 and the opposing flanges 16.1, 16.2. The guide means 17 are preferably configured such that their cross-sectional shape is corresponds to the cross-sectional shape of the space between the opposing flanges 16.1, 16.2.

Thus, the circumferential envelope surface of the roll 17 comprises a first circumferential flange 17.1 which is located on a side of the roll which is directed towards the inner surface 71.2 of the carriage 71. The roll 17 further comprises a second circumferential flange 17.2 which is located on a side of the roll which faces away from the inner surface 71.2 of the carriage. The first and the second circumferential flanges 17.1 and 17.2 are spaced apart such that a circumferential groove 17.3 is formed there between. The inner surfaces of the circumferential flanges 17.1, 17.2 face each other and are inclined such that the groove 17.3 widens in radial direction outwards.

Figure 2F:
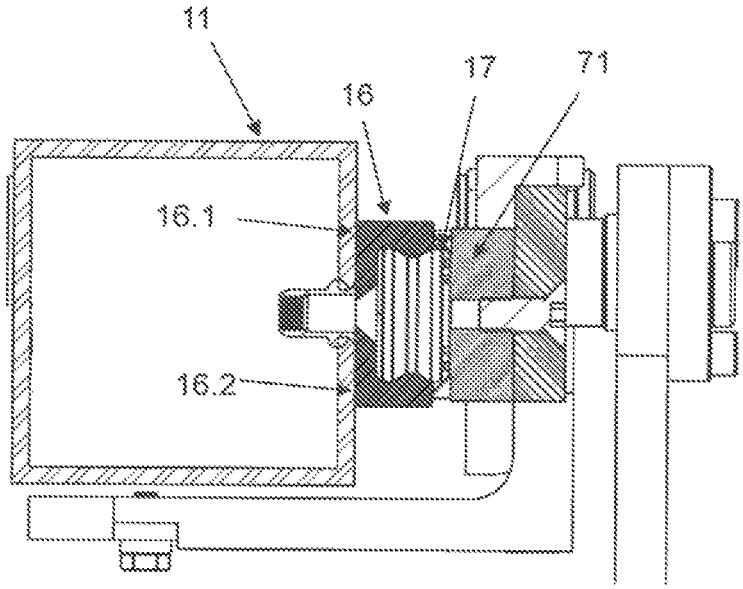

FIG. 2*f* is a cross sectional view of the support beam 11 of FIG. 2*c* along line A-A and shows a roll 17 in engaging contact with the flanges 16.1, 16.2 of the guide rail 16. In order not to obscure the features shown in FIG. 2*e* some of the reference signs have been left out. The first and the second circumferential flanges 17.1 and 17.2 of the roll 17 engages thereby on both sides of the ridge 16.4 of the guide rail 16 such that the ridge 16.4 is received in the circumferential groove 17.3 of the roll. In addition thereto the second circumferential flange 17.2 of the roll 17 is received in the undercut 16.5 of the guide rail. The guide roll 17 is thereby locked in engagement with the first and the second flanges 16.1 and 16.2 of the guide rail 16 and is allowed to move in the longitudinal direction of the guide rail but prevented from any movement in direction towards or away from the bottom 16.3 of the guide rail 16.

The function of the linkage arrangement of the lifting jig is following described with reference to FIGS. 4*a*-4*d*. For clarity the FIGS. 4*a*-4*d* shows only the side of the support beam 11 and the linkage arrangement 40 with an arm 51, a push rod 61 and a carriage 71. Also shown is lifting yoke 20 (not visible in FIG. 4*a*) and the lifting rail 30. In the description hereinafter reference is made to lifting of façade elements. However, it is appreciated that other elements maybe lifted by the lifting jig according to the present disclosure.

Figure 4A:
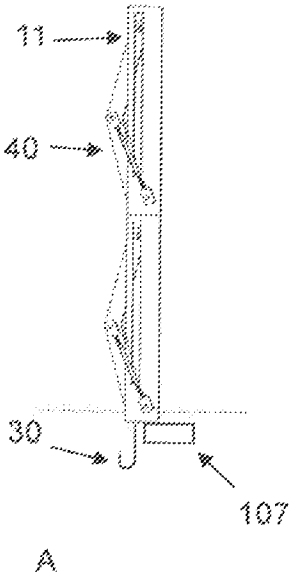
FIG. 4*a*-4*d*: Schematically side view drawings of the linkage arrange of the lifting jig in various positions.
Figure 4B:
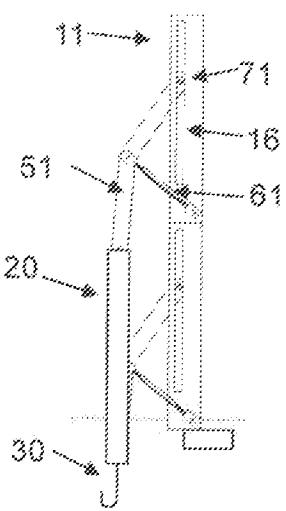
Figure 4C:
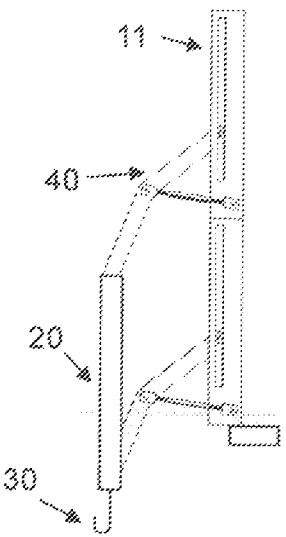
Figure 4D:
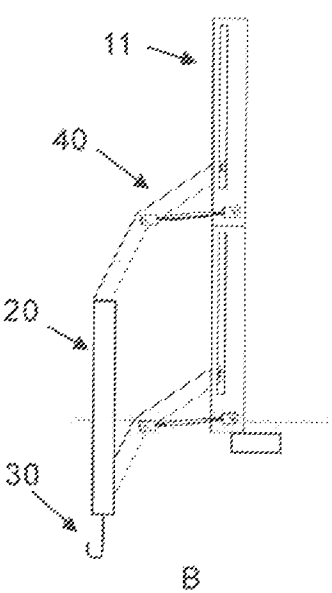

FIG. 4*a* shows the lifting jig in the element lifting position A, immediately after the lifting jig has stopped after being lowered in the guide profiles on a building down to the conveyor (see FIG. 1). In this position, a stop block 107 in the guide profile blocks the base frame of the lifting jig from further movement downwards. When the base frame of the lifting jig is resting on the stop the lifting yoke 20, which is not blocked, forces the carriages 71 to move downwards along the rails 16 in the vertical support beams 11,12. Thus, it is weight of the lifting yoke that forces the carriages to move downwards in the rails 16. During the downward movement of the carriages, the push rods 61, which are pivotally connected to both the pivot arm and the carriage pushes the arms 51 outwards such that the arms move in an arc shape outwards and downwards (FIGS. 4*b* and 4*c*). The movement continues until the carriages reach a stop, or until the contact element on the lifting yoke abuts the conveyor. The lifting jig is then in the element engagement position B (FIG. 4*d*). The return movement of the linkage arrangement follows exactly the reverse path of the downward movement and initiates when the hoisting crane pulls the lifting yoke upwards.

In the above description, the lifting jig has mainly been described in the context of a lifting rail which is fixed onto the base beam of the lifting joke. Such lifting rail is typically used when the lifting jig initially is waiting in the façade engagement position B whereby the façade element is transported to the lifting jig and is hung onto the lifting rail of the lifting jig.

However, to reduce the installing time of the façade elements it is more preferred to transport a façade element to a position for lifting while a subsequent façade element is hoisted. Thus, instead of having the lifting jig waiting for a façade element, a façade element is waiting for the lifting jig.

But, since the lifting jig perform exactly the same path of movement from a lifting position A to the façade engagement position B it cannot engage the lifting profile of a waiting façade element.

According to a preferred embodiment of the lifting jig, at least a longitudinal section of the lifting rail 30 is therefore pivotal in relation to the base beam 22 of the lifting yoke 20. Thus, at least a longitudinal section of the lifting rail 30, or the entire lifting rail 30 may pivot along its entire length in a direction perpendicular to the longitudinal extension of the base beam.

The function of the pivotal lifting rail will be described in the following with reference to FIGS. 5*a*-5*d*.

In FIGS. 5*a*-5*d* the lifting jig is shown schematically in side view. For clarity the figures show only some parts of the lifting jig, i.e. the side of the support beam 11, the linkage arrangement 40, the lifting yoke 20 (not shown in FIG. 5*a*) and the pivotal lifting rail 30. Also shown in each of FIG. 5*a*-5*d* is a façade element 105, a façade lifting profile 106 and the conveyor 103 on which the façade element is hanging. It is appreciated that the lifting jig performs the same outwards downwards arc-shaped movement path as described under FIGS. 4*a*-4*d*.

FIG. 5*a* shows the lifting jig 1 in the lifting position A. The façade element 105 is already in place, waiting to be lifted. To engage the façade element, the hook 326 of the lifting rail 30 must come in under and engage the façade element hanging on the lifting profile 106.

In FIG. 5*b*, the linkage arrangement 40 has moved the lifting yoke towards the façade element 105 and the hook 326 of the lifting rail 30 collides with the lifting profile 106 of the façade element 105. Since the lower portion of the lifting rail is pivotally attached to the upper portion of the lifting rail it swings back from the façade lifting profile against the force from the spring means 28 (FIG. 5*c*). Meanwhile, the linkage arrangement 40 continuous to move the lifting yoke 20 downwards outwards whereby the pivotal lifting rail 30 slides along the lifting profile, forced by pressure from the spring 28 against the lifting profile, until the hook 326 of the lifting rail snaps in under the façade lifting profile 106 (FIG. 5*d*).

Figure 6:
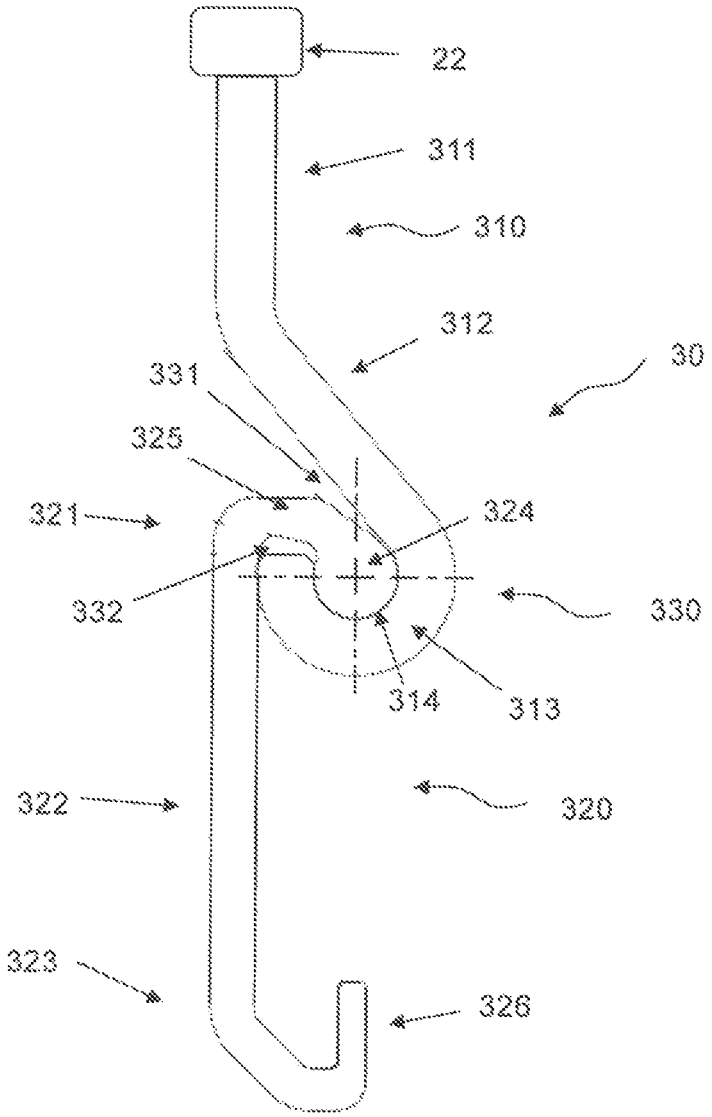
FIG. 6: A schematically side view drawing of an alternative lifting rail of the lifting jig.

FIG. 6 shows schematically a side view of the lifting rail 30 comprised in the lifting yoke 20 of FIG. 3*a*. It should be noted that FIG. 6 shows the profile of the lifting rail in FIG. 3*a*, i.e. its cross-section.

The lifting rail 30 shown in FIG. 6 comprises a first lifting rail section 310 and a second lifting rail section 320 which are pivotally interconnected in a hinge joint 330 such that the second lifting rail section 320 may pivot in relation to the first lifting rail section 310 which is attached by its upper portion 311 to the base beam 22 of the lifting yoke.

The second lifting rail section 320 comprises an upper portion 321 and a lower portion 323 which is formed into a hook 326 to engage a façade element. A straight middle portion 322 interconnects the lower portion 323 with the upper portion 321. The upper portion 321 is formed into a bead 324 of generally cylindrical shape which protrudes on a stem 325 from the upper portion 321.

The straight upper portion 311 of the first lifting rail section 310 is connected to a middle portion 312 which extends in an angle away from the upper section 311, to the lower portion 313. The lower portion 313 is formed into a round open loop 313 which has an inner cylindrical cavity 314 for receiving the protruding cylindrical bead 324 of the second lifting rail section 320. Thus, the loop 313 forms a socket for receiving the cylindrical bead 324.

To allow the cylindrical bead 324 to pivot in the cylindrical cavity 313 of the loop 313 a first clearance 331 is provided between the upper surface of the bead 324 and the angular middle portion 312 of the first lifting section 310. A second clearance 332 is provided between the stem 325 and end surface of the loop 313. Of course the first clearance and second clearance 331, 332 must be large enough to allow the second lifting rail section 320 to swing back sufficiently. However if the clearances 331, 332 are too large there is a risk that the second lifting rail section 320 comes loose. The exact shape and dimensions of the protruding bead 324 and the cylindrical cavity 314 as well as the dimensions of the clearances 331 and 332 must therefore be determined by the skilled person in dependency of the degree of pivotal movement that is necessary in the lifting operation.

As described above under FIG. 2*a* and under FIGS. 5*a*-5*d* a spring means 28 (not shown in FIG. 6) is provided to bias the second lifting rail section 320 in direction towards the hook 326.

In the following will an additional and alternative feature of the lifting jig be described.

As described, the lifting jig and the façade element are hoisted in the same guide rails on the building. To ensure proper functionality of the lifting it is therefore preferable that the horizontal positions of the façade element and the lifting rail of the lifting jig are centered.

To improve centering, the second pivotal lifting rail section 320 of the lifting jig may comprise a centering-locking arrangement 200 for centering and locking the lifting rail of the lifting jig in engagement with the lifting profile of a façade-element.

Figure 7:
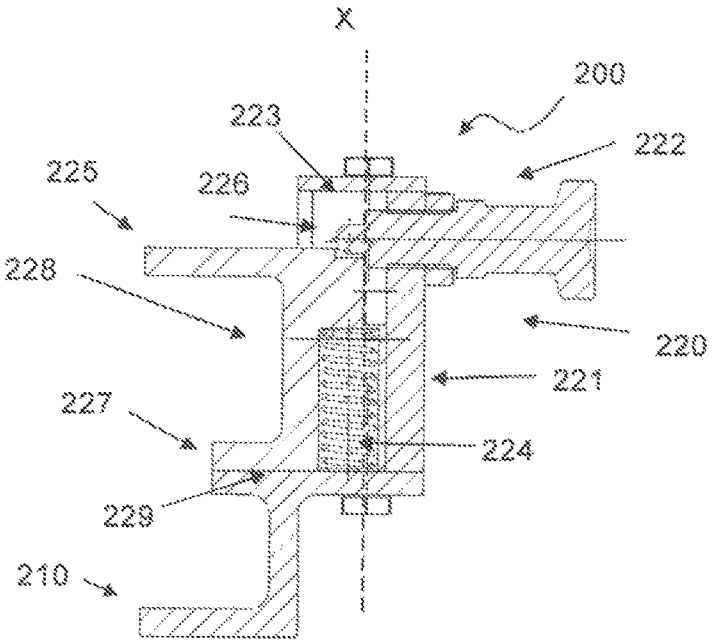
FIG. 7: A schematically cross-sectional drawing of a centering-locking device in the lifting jig.

FIG. 7 shows cross-sectional view of the locking-centering device 200. The locking-centering device is also visible in FIGS. 3*a*, and 3*b*.

The locking-centering device 200 comprises an upper locking portion 220, which comprises a first locking plate 225 and a second locking plate 227, which are interconnected by a middle section 228 into a single piece. The locking plates 225, 227 are movable in vertical direction in a housing 221 against the force of a spring 224, e.g. a cylindrical coil spring. The housing comprises an upper abutment surface 223 and a lower abutment surface 229. The locking plates 225, 227 are movable from an upper released position, in which the first locking plate is in contact with the upper abutment surface 223 of the housing to a locked position (shown in FIG. 7) in which the second locking plate is in contact with the lower abutment surface 229 of the housing 221. The upper portion of the housing 221 comprises a spring biased locking knob 222. The knob 222 is movable in horizontal direction, perpendicular to a longitudinal axis (X) extending through the upper and lower support surfaces 225, 227. The locking knob is thereby movable from a release position, in which the knob is not in contact with the locking plates to a locking position, in which a portion 223 of the locking knob is in engagement with a portion 226 of the upper locking plate 225. The locking knob thereby blocks the locking plates in their locked position, i.e. in which the second locking plate is in contact with the lower abutment surface 229 or the housing 221.

The first and second locking plates 227, 225 extend horizontally from the middle section. The first locking plate 225 is longer than the second locking plate such that it extends over the second locking plate 227.

Below the locking plates is a centering plate 210 arranged. The centering plate extends horizontally in same direction as the locking plates and the locking knob, i.e. perpendicular to longitudinal axis X. The length of the centering plate 210 is approximately the same as the length of the upper locking plate.

Figure 8A:
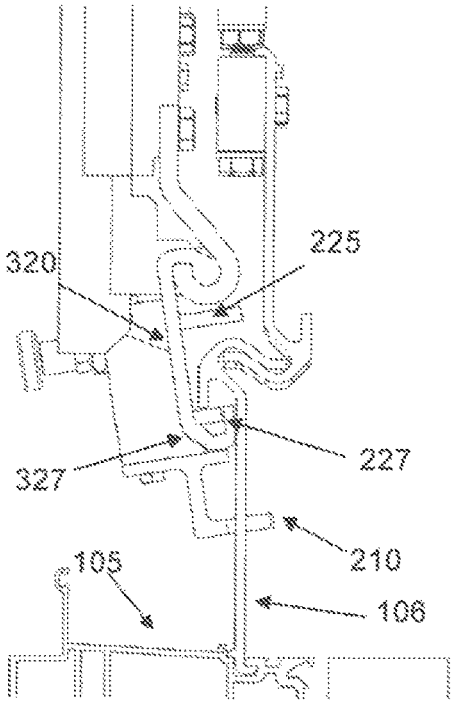
FIG. 8*a*, 8*b*: Schematically drawings of the centering-locking device in released and locked position, respectively.
Figure 8B:
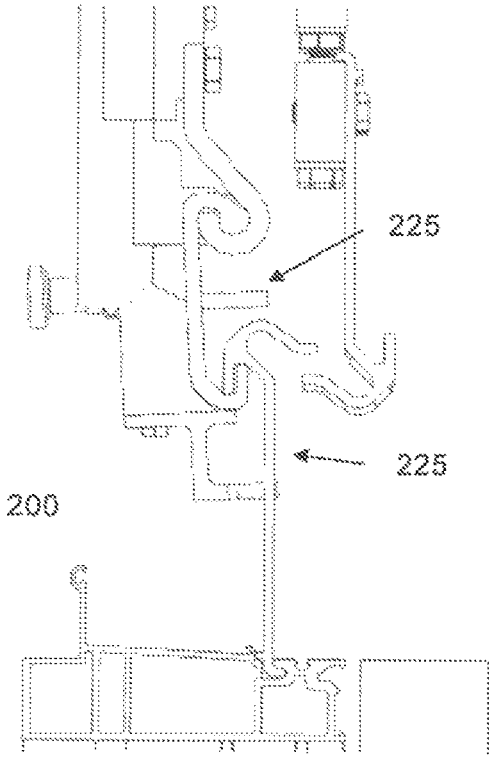

FIGS. 8*a* and 8*b* shows the locking device in operation when the lifting rail of the lifting jig engage the lifting profile 106 of a façade element 105. The locking-centering device 200 is attached in the centre of the lifting jig such that the first and second locking plates 225, 227 extends through corresponding openings (not shown) in the second lifting rail section 320. The centering plate 210 extends under the hook 326 of the lifting rail.

In FIG. 8*a*, the lifting hook 326 has started to engage the lifting profile of the façade element and the centering plate 210 is inserted into a corresponding opening (not shown) in the centre of the lifting profile of the façade element. Thus, the lifting rail 30 of the lifting jig and the lifting profile of the façade element are centered. When the pivotal lifting rail section 320 engage the lifting profile 106, the lifting profile 106 presses down on the second (lower) locking plate 227. This causes the locking plates 225, 227 to move vertically downwards towards the hook 326.

As described with reference to FIG. 7, The locking plates moves vertically downwards in the housing 221 of the locking arrangement 200. When the second locking plate reaches the lower abutment surface 229 the locking knob may enter into the clearance 226 which is exposed above the upper locking plate and blocks the locking plates from vertical movement upwards.

FIG. 8*b* shows the locking device 200 in a locked position. Thereby is the first (upper) locking plate 225 close to the lifting profile 106 and prevents the lifting profile from being unhooked.

Although a particular embodiment has been disclosed in detail this has been done for purpose of illustration only, and is not intended to be limiting. In particular it is contemplated that various substitutions, alterations and modifications may be made within the scope of the appended claims.

Moreover, although specific terms may be employed herein, they are used in a generic and descriptive sense only and not for purposes of limitation. Furthermore, as used herein, the terms "comprise/comprises" or "include/includes" do not exclude the presence of other elements. Finally, reference signs in the claims are provided merely as a clarifying example and should not be construed as limiting the scope of the claims in any way.

The invention claimed is:

1. A lifting jig for lifting elements along a façade of a building, comprising:

a base frame comprising parallel first and second vertical support beams to be slidably received into two parallel guide profiles mounted on a façade of a building;

a lifting yoke comprising a horizontal base beam and a lifting frame extending vertically from said horizontal base beam;

a lifting rail for engaging an element to be lifted, said lifting rail extending from said horizontal base beam, a link arrangement for pivotally coupling the lifting yoke to the base frame such that the lifting yoke is movable from an element lifting position (A) to an element engagement position (B), wherein the link arrangement comprises at least two links, each link comprising a pivot arm comprising a first end and a second end and a push rod comprising a first end and a second end and a carriage, wherein, the first end of each pivot arm is pivotally attached to a carriage and the second end of each pivot arm is pivotally attached to the lifting yoke and the first end of each push rod is pivotally attached to a pivot arm and the second end of each push rod is pivotally attached to the first and the second vertical support beams, respectively, wherein the first and second vertical support beams respectively comprises a guide rail having a first and a second opposing flange and extending along at least a portion of said first and second vertical support beams in direction from an upper end towards a lower end thereof and that, the first and the second carriage respectively comprises at least one guide arranged between the opposing flanges of the respective guide rail, wherein said at least one guide is movable between the first and the second opposing flange along said guide rail.

2. The lifting jig according to claim 1, wherein the first and the second flange respectively comprises a ridge extending along at least a section of said first and second flange and wherein the guide comprises a groove which is configured to receive the ridge.

3. The lifting jig according to claim 1, wherein said at least one guide is a roll which is rotationally attached to the first and the second carriage.

4. The lifting jig according to claim 3, wherein the at least one roll comprises a first and a second circumferential flange.

5. The lifting jig according to claim 4, wherein the first and the second flange of the guide rail respectively comprises an undercut for receiving a circumferential flange of the roll.

6. The lifting jig according to claim 1, wherein the link arrangement comprises four links, each link comprising a pivot arm comprising a first end and a second end and a push rod comprising a first end and a second end and a carriage, wherein one pair of carriages are movably arranged on the first vertical support beam and a second pair of carriages are movably arranged on the second vertical support beam, wherein, the first end of each pivot arm is pivotally attached to a carriage and the second end of each pivot arm is pivotally attached to the lifting yoke and the first end of each push rod is pivotally attached to a pivot arm and the second end of each push rod is pivotally attached to the first and the second vertical support beam, respectively.

7. The lifting jig according to claim 1, wherein the lifting frame comprises a first and a second lifting beam, wherein one end of each lifting beam is attached on opposite sides of the centre of the base beam and wherein the second ends of the first and the second lifting beams are joined over the centre of the base beam such that the lifting frame forms a triangle.

8. The lifting jig according claim 1, wherein the lifting yoke comprises a linkage frame comprising first and second linkage rods arranged parallel to each other and extending vertically from the base beam, and a third linkage rod extending horizontally along the base beam, wherein the third linkage rod is connected to the upper ends of the first and a second linkage rods and wherein the linkage frame comprises pivot pins for pivotal attachment to the pivot arms.

9. The lifting jig according to claim 1, wherein the pivot arms are bent, such that a first end of a pivot arm forms an angle with the second end of the pivot arm and wherein the push rod is pivotally attached to the area of the bend.

10. The lifting jig according to claim 1, wherein the lifting rail is pivotally arranged at the base beam.

11. The lifting jig according to claim 10, wherein the lifting rail is pivotally attached to the base beam.

12. The lifting jig according to claim 10 comprising a centering-locking device for centering and locking the lifting rail in engagement with a façade element lifting profile.

13. The lifting jig according to claim 12, wherein the centering-locking device comprises a first locking plate and a second locking plate, which are movable in vertical direction in a housing, wherein;

the housing comprises an upper abutment surface and a lower abutment surface, wherein, the locking plates are movable from an upper released position, in which the first locking plate is in contact with the upper abutment surface to a locked position in which the second locking plate is in contact with the lower abutment surface and, a locking knob which is movable in the housing towards and away from the upper and lower locking plates, wherein the locking knob is movable from a release position, in which the locking knob is free of contact with the locking plates to a locking position, in which the locking knob is in contact the upper locking plate and thereby blocks the locking plates in the locked position.

14. The lifting jig according to claim 12 comprising a centering plate arranged below the and extending parallel to the centering-locking device.

15. The lifting jig according to claim 1, wherein the lifting rail comprises a first rail section having an upper portion and a lower portion, wherein the upper portion is attached to the base beam and a second rail section having an upper portion and a lower portion, which is formed into a lifting hook for engaging a façade element, whereby the lower portion of the first rail section and the upper portion of the second rail section are joined in a hinge joint.

16. The lifting jig according to claim 15, wherein the upper portion of the second rail section is formed into a protruding cylindrical bead and wherein the lower portion of the first rail section is formed into a socket having a cylindrical cavity adapted to pivotally receive the protruding cylindrical bead of the second rail section, wherein the protruding cylindrical bead is pivotally received in the into the cylindrical cavity to form a hinge joint.

17. The lifting jig according to claim 15, comprising at least one spring arranged to act on the second rail section on a side opposite to the lifting hook such that the second rail section is biased in direction of the lifting hook.

* * * * *